US012339095B2

(12) United States Patent
Fritts et al.

(10) Patent No.: US 12,339,095 B2
(45) Date of Patent: Jun. 24, 2025

(54) SLING-ATTACHED SQUEEZE BAGS, SLINGS FOR SLING- ATTACHED SQUEEZE BAGS, SHOULDER-FIRED PROJECTILE WEAPONS THAT UTILIZE SLING-ATTACHED SQUEEZE BAGS, AND RELATED METHODS

(71) Applicant: Landshark Construction Services LLC, Lake Havasu City, AZ (US)

(72) Inventors: Kenneth Dane Fritts, Dana Point, CA (US); Duncan Dean Jones, Laguna Beach, CA (US)

(73) Assignee: Landshark Construction Services LLC, Lake Havasu City, AZ (US)

( * ) Notice: Subject to any disclaimer, the term of this patent is extended or adjusted under 35 U.S.C. 154(b) by 0 days.

(21) Appl. No.: 18/483,837

(22) Filed: Oct. 10, 2023

(65) Prior Publication Data

US 2024/0125577 A1 Apr. 18, 2024

Related U.S. Application Data

(60) Provisional application No. 63/475,082, filed on Oct. 13, 2022, provisional application No. 63/475,102, filed on Oct. 13, 2022.

(51) Int. Cl.
*F41C 33/00* (2006.01)

(52) U.S. Cl.
CPC ..... *F41C 33/001* (2013.01); *F41C 33/002* (2013.01)

(58) Field of Classification Search
CPC ..... F41C 23/14; F41C 33/002; F41C 33/001
(Continued)

(56) References Cited

U.S. PATENT DOCUMENTS 5,110,022 A * 5/1992 Dvoroznak ..... F41C 33/002 224/584
8,516,733 B1 * 8/2013 Richey, Jr. ..... F41C 23/16 42/94

(Continued)

OTHER PUBLICATIONS

NPL: https://web.archive.org/web/20190615032141/https://unitedstatestactical.com/rifle-sling-bag/ Jun. 15, 2019.*

*Primary Examiner* — John Cooper
(74) *Attorney, Agent, or Firm* — Kolitch Romano Dascenzo Gates LLC

(57) ABSTRACT

Sling-attached squeeze bags, slings for sling-attached squeeze bags, shoulder-fired projectile weapons that utilize sling-attached squeeze bags, and related methods. The squeeze bags include a cover material that defines an enclosed bag volume. The squeeze bags also include a sling-receiving region that is sized to receive a sling strap of a sling of the shoulder-fired projectile weapon and a particulate fill-material positioned within the enclosed bag volume. The slings include a sling strap that defines a bag-receiving strap region configured to be received within a sling-receiving region of a sling-attached squeeze bag, a first attachment strap extending from a first end region of the sling strap, and a second attachment strap extending from the first end region of the sling strap. The slings also include a first sling-attachment structure operatively attached to the first attachment strap and a second sling-attachment structure operatively attached to the second attachment strap.

20 Claims, 6 Drawing Sheets

(58) Field of Classification Search
USPC ..... 42/94
See application file for complete search history.

(56) References Cited

U.S. PATENT DOCUMENTS

| | | | | |
|---|---|---|---|---|
| 10,323,898 | B1 * | 6/2019 | Phillips | F41A 23/16 |
| 11,280,581 | B1 * | 3/2022 | Ollivier | F41C 33/001 |
| 2011/0131861 | A1 * | 6/2011 | Seuk | F41C 27/22<br>42/94 |
| 2020/0103197 | A1 * | 4/2020 | Coleman | F41C 27/22 |
| 2022/0049925 | A1 * | 2/2022 | Brady | F41A 23/06 |

* cited by examiner

SLING-ATTACHED SQUEEZE BAGS, SLINGS FOR SLING- ATTACHED SQUEEZE BAGS, SHOULDER-FIRED PROJECTILE WEAPONS THAT UTILIZE SLING-ATTACHED SQUEEZE BAGS, AND RELATED METHODS

RELATED APPLICATIONS

This application claims priority to U.S. Provisional Patent Application Ser. Nos. 63/475,082 and 63/475,102, which were both filed on Oct. 13, 2022, the complete disclosures of which is hereby incorporated by reference.

FIELD OF THE DISCLOSURE

The present disclosure relates generally to sling-attached squeeze bags, to slings for sling-attached squeeze bags, to shoulder-fired projectile weapons that utilize sling-attached squeeze bags, and to related methods.

BACKGROUND OF THE DISCLOSURE

Shoulder-fired projectile weapons, such as rifles, may be utilized to fire a projectile at a target. When high accuracy is desired and/or when firing projectiles over long distances, it is known to provide a bench and/or a rest to increase stability of the shoulder-fired projectile weapon, thereby improving accuracy and/or precision of shot placement. Bench rests, bench bags, and/or conventional squeeze bags may be utilized in certain circumstances, such as when target shooting at a range. However, they may be ineffective, they may be heavy, and/or they may be cumbersome to carry and/or to utilize in other circumstances, such as during hunting or other mobile shooting activities. They also may be time-consuming to set up and/or utilize, making them impractical when quick shots are required. Thus, there exists a need for sling-attached squeeze bags, for slings for sling-attached squeeze bags, for shoulder-fired projectile weapons that utilize sling-attached squeeze bags, and/or for related methods.

SUMMARY OF THE DISCLOSURE

Sling-attached squeeze bags, slings for sling-attached squeeze bags, shoulder-fired projectile weapons that utilize sling-attached squeeze bags, and related methods are disclosed herein. The squeeze bags include a cover material that defines an elongate bag axis and an enclosed bag volume. The squeeze bags also include a sling-receiving region that extends along the elongate bag axis and is sized to receive a sling strap of a sling of the shoulder-fired projectile weapon. The squeeze bags further include a particulate fill-material, positioned within the enclosed bag volume.

The slings include a sling strap that defines a bag-receiving strap region configured to be received within a sling-receiving region of a sling-attached squeeze bag, a first attachment strap extending from a first end region of the sling strap, and a second attachment strap extending from the first end region of the sling strap. The slings also include a loop defined on an opposed second end region of the sling strap, a first sling-attachment structure operatively attached to the first attachment strap and configured to be selectively attached to a left side of a stock of the shoulder-fired projectile weapon, and a second sling-attachment structure operatively attached to the second attachment strap and configured to be selectively attached to a right side of the stock of the shoulder-fired projectile weapon.

The shoulder-fired projectile weapon includes an action, a stock extending from the action configured to be shouldered by a user of the shoulder-fired projectile weapon, and a sling. The shoulder-fired projectile weapon also includes a sling-attachment structure that operatively attaches the sling to the stock and a sling-attached squeeze bag operatively attached to the sling.

Methods of attaching a sling-attached squeeze bag to a shoulder-fired projectile weapon include inserting the sling strap into the sling-receiving region. The methods of attaching also include operatively attaching the sling to the shoulder-fired projectile weapon.

Methods of utilizing the shoulder-fired projectile weapons include positioning the squeeze bag between a stock of the shoulder-fired projectile weapon and a support surface, wherein, during the positioning, a sling of the shoulder-fired projectile weapon extends through a sling-receiving region of the sling-attached squeeze bag. The methods of utilizing also include squeezing the sling-attached squeeze bag to decrease a mobility of the stock, with the squeezing the sling-attached squeeze bag including squeezing the sling via the sling-attached squeeze bag.

DETAILED DESCRIPTION AND BEST MODE OF THE DISCLOSURE

Figure 1:
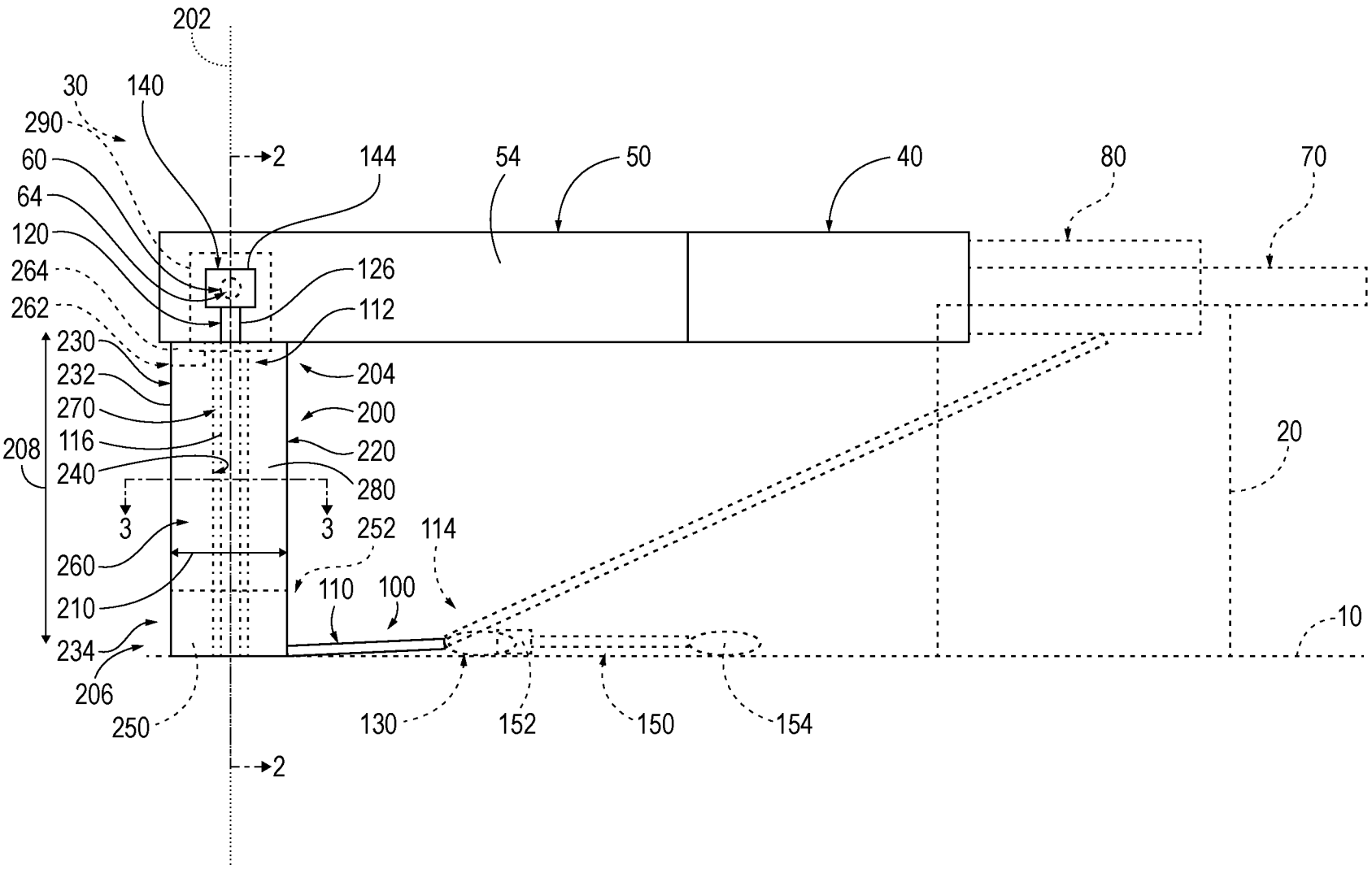
FIG. 1 is a schematic right-side view illustrating examples of shoulder-fired projectile weapons that include slings and sling-attached squeeze bags, according to the present disclosure.

FIGS. 1-6 provide examples of sling-attached squeeze bags 200, slings 100 for the sling-attached squeeze bags, and/or shoulder-fired projectile weapons that include and/or utilize the sling-attached squeeze bags, according to the present disclosure. Elements that serve a similar or at least substantially similar purpose are labeled with like numbers in each of FIGS. 1-6, and these elements may not be discussed in detail herein with reference to each of FIGS. 1-6. Similarly, all elements may not be labeled in each of FIGS. 1-6, but reference numerals associated therewith may be utilized herein for consistency. Elements, components, and/or features that are discussed herein with reference to one or more of FIGS. 1-6 may be included in and/or utilized with any of FIGS. 1-6 without departing from the scope of the present disclosure.

In general, elements that are likely to be included in a particular embodiment are illustrated in solid lines, while elements that may be optional are illustrated in dashed lines. However, elements that are shown in solid lines may not be essential to all embodiments and, in some embodiments, may be omitted without departing from the scope of the present disclosure.

Figure 2:
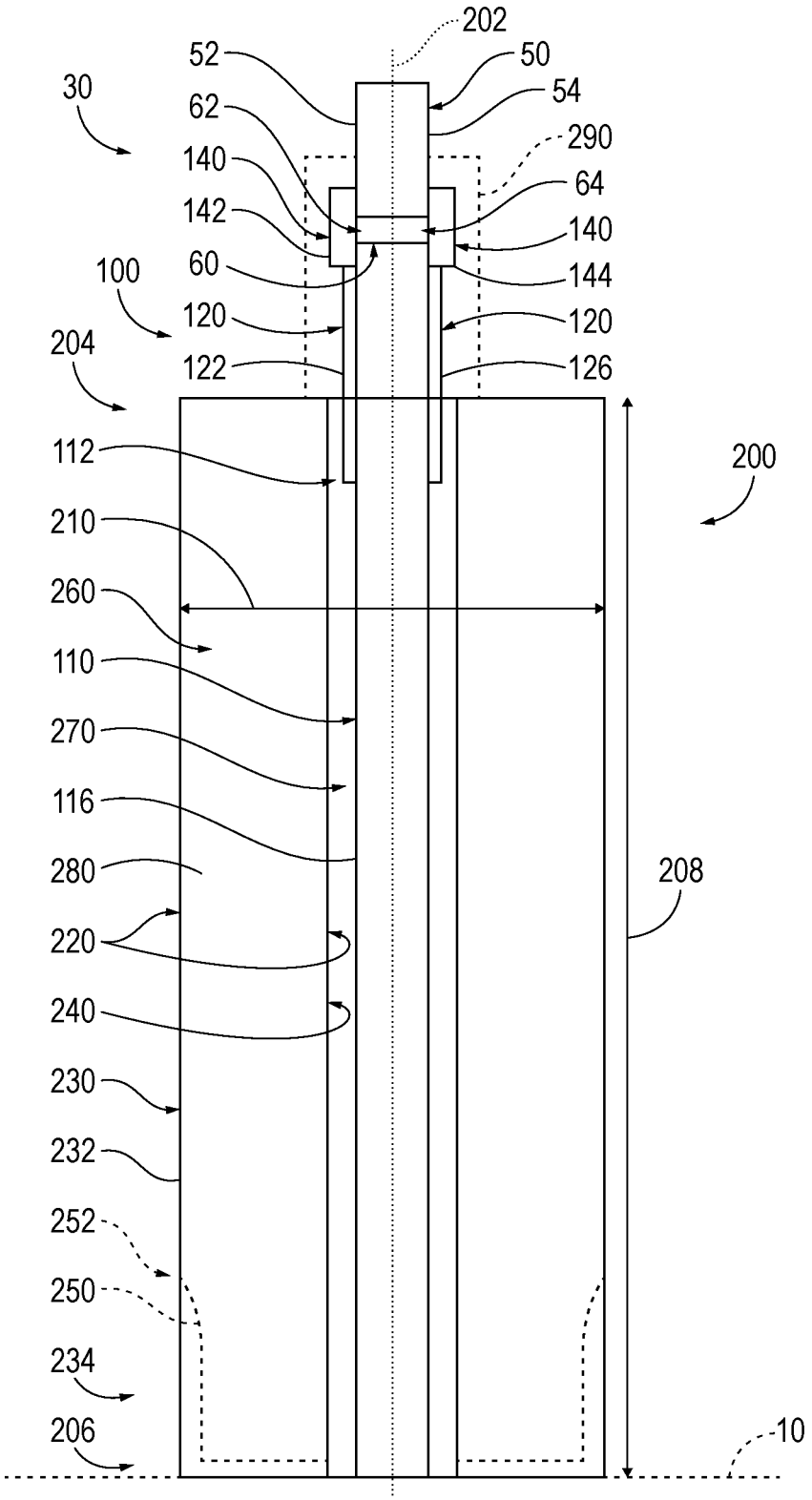
FIG. 2 is a schematic cross-sectional view of the illustrative example shoulder-fired projectiles weapons of FIG. 1 taken along line 2-2 of FIG. 1.
Figure 3:
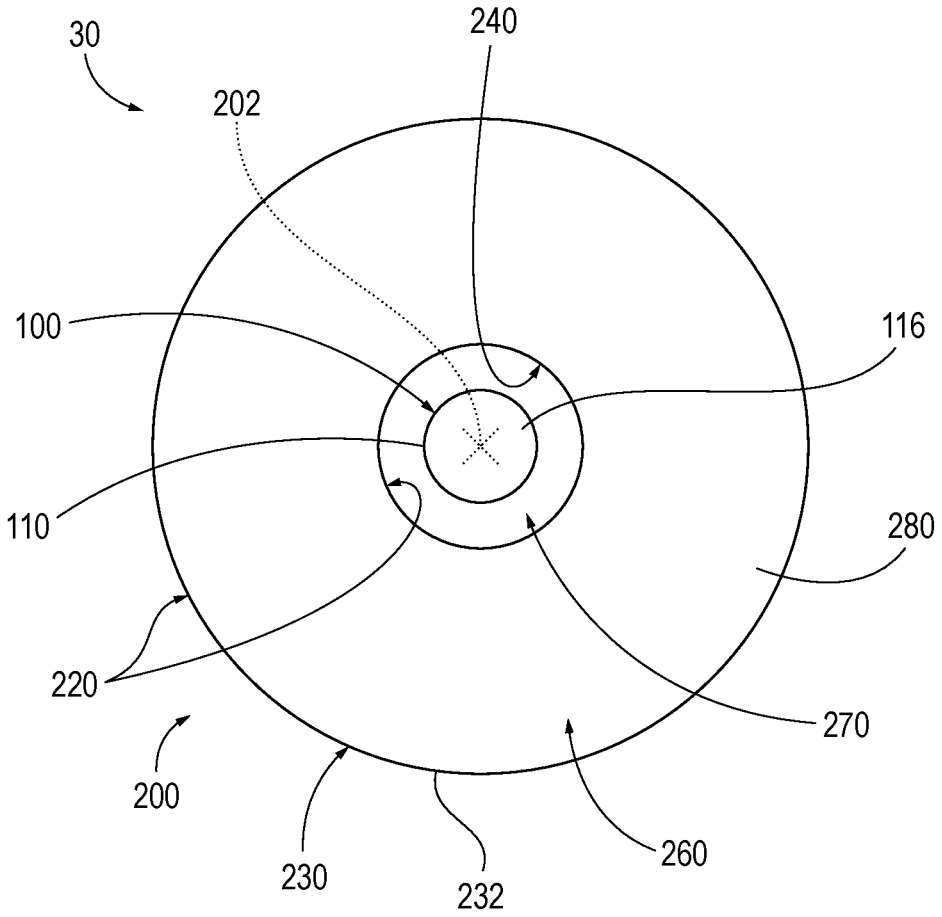
FIG. 3 is a schematic cross-sectional view of the example shoulder-fired projectile weapons of FIG. 1, taken along line 3-3 of FIG. 1.

FIG. 1 is a schematic right-side view illustrating examples of shoulder-fired projectile weapons 30 that include slings 100 and sling-attached squeeze bags 200, according to the present disclosure. FIG. 2 is a schematic cross-sectional view of shoulder-fired projectiles weapons 30 of FIG. 1 taken along line 2-2 of FIG. 1, and FIG. 3 is a schematic cross-sectional view of shoulder-fired projectile weapons 30 of FIG. 1 taken along line 3-3 of FIG. 1. Examples of shoulder-fired projectile weapon 30 include a firearm, a rifle, a modern sporting rifle, a shotgun, a speargun, a paintball gun, and/or a crossbow.

As collectively illustrated by FIGS. 1-3, and with specific reference to FIG. 1, shoulder-fired projectile weapons 30 include an action 40, a stock 50, a sling 100, a sling-attachment structure 140, and a sling-attached squeeze bag 200. Stock 50 extends from action 40 and is configured to be shouldered by a user of the shoulder-fired projectile weapon. Sling 100 is operatively attached to stock 50 via sling-attachment structure 140, and sling-attached squeeze bag 200 is operatively attached to sling 100.

Action 40 may include any suitable structure that may, or that may be utilized to, load, fire, extract, and/or eject a projectile fired by the shoulder-fired projectile weapon. More specific examples of action 40 include a loading mechanism, a trigger, a firing-pin, an extractor, and/or an ejector.

Stock 50 may include any suitable structure that may be adapted, configured, designed, and/or constructed to be shouldered by the user, such as to stabilize the shoulder-fired projectile weapon during firing thereof. Examples of stock 50 include a rifle stock, a shotgun stock, a telescopic stock, a collapsible stock, and/or a modern sporting rifle stock.

Sling-attachment structure 140 may include any suitable structure that may be adapted, configured, designed, and/or constructed to operatively attach sling 100 to shoulder-fired projectile weapon 30, such as to stock 50 thereof. Examples of sling-attachment structure 140 include a clip, a clasp, a fastener, a swivel, a sling swivel, a sling mount, a quick-detach sling mount, a sling quick-detach, and/or a quick-detach sling swivel.

Figure 4:
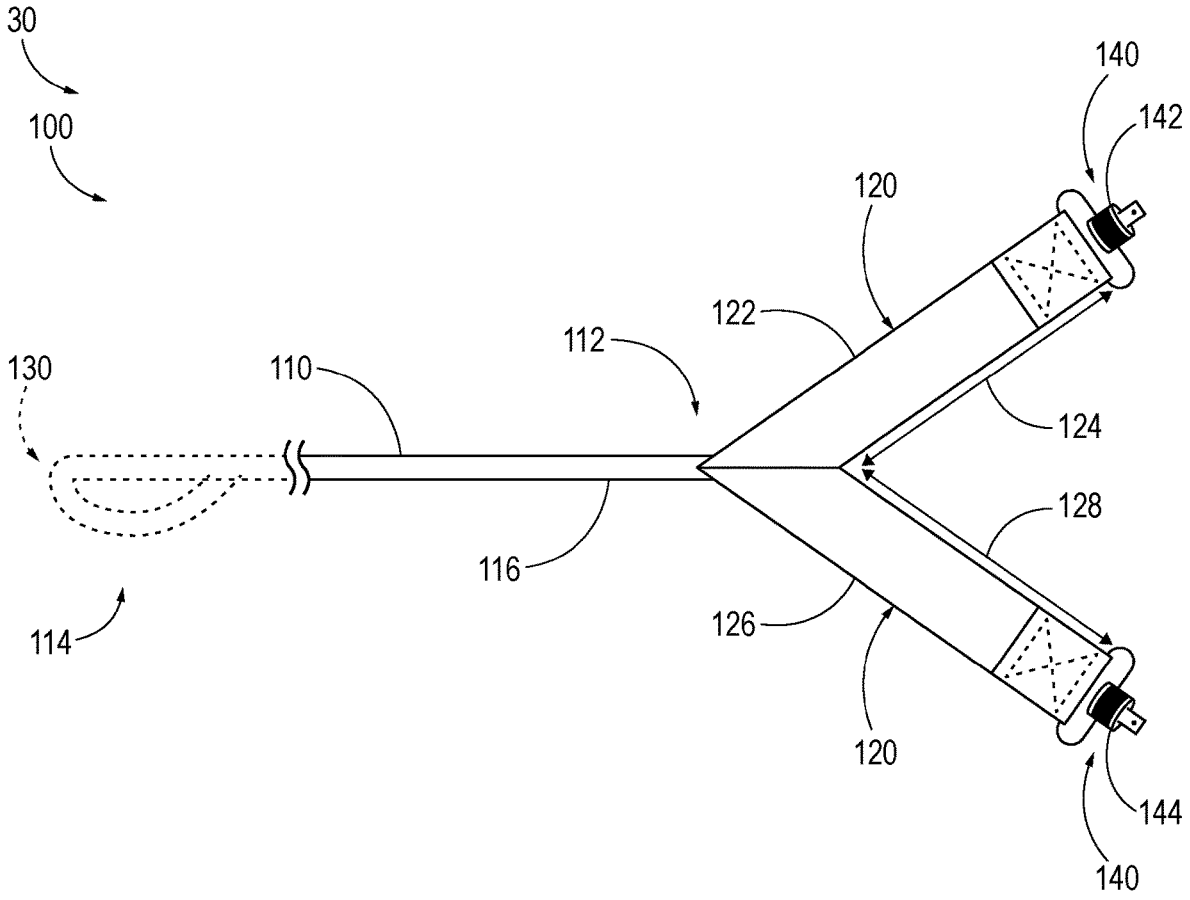
FIG. 4 is a less schematic illustrative example of slings for sling-attached squeeze bags, according to the present disclosure.

In some examples, and as perhaps best illustrated in FIGS. 2 and 4, sling 100 may include a plurality of sling-attachment structures 140 including a first sling-attachment structure 142 and a second sling-attachment structure 144. In such examples, stock 50 may include a plurality of receptacles, such as including at least a first receptacle 62 and a second receptacle 64. First receptacle 62 is configured to receive, interface with, and/or interlock with the first sling-attachment structure and defined on a left side 52 of the stock. Second receptacle 64 is configured to receive, interface with, and/or interlock with the second sling-attachment structure and defined on a right side 54 of the stock. Also in such examples, first receptacle 62 may be coaxial with second receptacle 64. Additionally or alternatively, a single hole 60 through stock 50 may extend between the left side and the right side of the stock and may at least partially, or even completely, define both the first receptacle and the second receptacle. Hole 60 also may be referred to herein as a passage 60, a recess 60, and/or a conduit 60.

Sling 100 may include any suitable structure that may have sling-attached squeeze bag attached thereto and/or that may be adapted, configured, designed, and/or constructed to permit improved transport and/or storage of the shoulder-fired projectile weapon by the user. Examples of sling 100 include any suitable strap and/or band that may be operatively attached to shoulder-fired projectile weapon 30 in at least one location, such as via sling-attachment structure 140, and that may be configured to be slung over and/or across a shoulder and/or chest of the user. Such as when the sling is utilized to carry and/or convey the shoulder-fired projectile weapon. In some examples, sling 100 may be operatively attached only to stock 50. In other examples, sling 100 may extend between stock 50 and one or more other structures of shoulder-fired projectile weapon 30, such as action 40, a barrel 70, and/or a forend 80.

More specific examples of sling 100 are illustrated in FIGS. 1-2 and 4. As collectively illustrated, slings 100 may include a sling strap 110 that defines a bag-receiving strap region 116, which is configured to be received within a sling-receiving region 270 of sling-attached squeeze bags 200. Examples of sling-receiving region 270 are disclosed herein.

As perhaps best illustrated in FIGS. 2 and 4, slings 100 also may include a plurality of attachment straps 120 including a first attachment strap 122 and a second attachment strap 126. First attachment strap 122 and second attachment strap 126 may extend from a first end region 112 of sling strap 110. A loop 130 may be defined on an opposed second end region 114 of the sling strap, as perhaps best illustrated in FIG. 4.

Slings 100 also may include a plurality of sling-attachment structures 140, including a first sling-attachment structure 142 and a second sling-attachment structure 144. First sling-attachment structure 142 may be operatively attached to first attachment strap 122 and/or may be configured to be selectively and/or separably attached to the left side of stock 50. Second sling-attachment structure 144 may be operatively attached to second attachment strap 126 and/or may be configured to be selectively and/or separably attached to the right side of the stock.

Slings 100, including sling strap 110, first attachment strap 122, and/or second attachment strap 126 may be formed and/or defined from any suitable strap material. Examples of the strap material include a fabric strap material, a webbed strap material, a nylon webbed strap material, a rubber strap material, a leather strap material, and/or a synthetic leather strap material.

As illustrated in FIG. 4, slings 100 may define a first distance 124 between first sling-attachment structure 142 and sling strap 110, as measured along, or along a length of, first attachment strap 122. As also illustrated, slings 100 may define a second distance 128 between second sling-attachment structure 144 and sling strap 110, as measured along, or along a length of, second attachment strap 126. As perhaps best illustrated in FIGS. 1-2, the first distance and the second distance may be selected to permit stock 50 to rotate, or to freely rotate, between first attachment strap 122 and second attachment strap 126, while the first sling-attachment structure is selectively attached to the left side of the stock and the second sling-attachment structure is selectively attached to the right side of the stock. In some examples, the first distance may be equal, or at least substantially equal, to the second distance. Such a configuration may permit and/or facilitate positioning sling-attached squeeze bag 200 between stock 50 and support surface 10, as illustrated, while also permitting the shoulder-fired projectile weapon to hang vertically downward when the sling is utilized to carry and/or convey the shoulder-fired projectile weapon.

As illustrated in FIGS. 1 and 4, sling 100 may include a loop 130. In some examples, loop 130 may be sized to receive a shoulder of the user. In such a configuration, sling 100 may be similar in function to a conventional single-point sling. However, as discussed, sling 100 may mount to stock 50 on both the left and the right side of the stock. Such a configuration may permit sling-attached squeeze bags 200 to be readily positioned between the stock and the support surface, as illustrated in FIGS. 1-2.

Alternatively, and as illustrated in FIG. 1, loop 130 also may be sized to receive and/or attach to a coupler 152 of a sling extension 150. In such examples, sling extension 150 may include a sling extension loop 154, which may be sized to receive a shoulder of the user. In such a configuration, sling extension 150 may include and/or be a conventional single-point sling, and sling 100 may adapt the conventional single-point sling for operative use with sling-attached squeeze bags 200.

Sling-attached squeeze bag 200 may include any suitable structure that may be operatively attached to sling 100 and/or that may be configured to increase stability, accuracy, and/or precision of shoulder-fired projectile weapon 30. As collectively illustrated by FIGS. 1-3 and 5-6, sling-attached squeeze bags 200, which also may be referred to herein as squeeze bags 200, include a cover material 220 that defines an elongate bag axis 202 and an enclosed bag volume 260. Squeeze bags 200 also include and/or define a sling-receiving region 270. Sling-receiving region 270 extends along, and in some examples along an entirety of, elongate bag axis 202 and is sized to receive sling strap 110 of sling 100, or bag-receiving strap region 116 thereof. Squeeze bags 200 further include a particulate fill-material 280, which is positioned within enclosed bag volume 260.

Squeeze bag 200 may have and/or define any suitable external size, shape, and/or contour. In some examples, squeeze bag 200 may be configured to be operatively attached to and/or utilized with shoulder-fired projectile weapon 30 during hunting and/or other mobile shooting activities. With this in mind, squeeze bag 200 may have a smooth, or at least substantially smooth, exposed outer surface 232. Additionally or alternatively, squeeze bag 200 may have a rounded, an at least partially rounded, an arcuate, and/or an at least partially arcuate exposed outer surface 232. Stated differently, squeeze bag 200 may be shaped to decrease a potential for snagging on brush and/or other objects when shoulder-fired projectile weapon 30 is carried by the user.

With the above in mind, and as illustrated, squeeze bag 200 may include and/or be a tubular, or at least substantially tubular, squeeze bag 200. Additionally or alternatively, squeeze bag 200 may include and/or be a cylindrical, or at least partially cylindrical, squeeze bag 200, an annular, or at least partially annular, squeeze bag, and/or a toroidal, an at least partially toroidal, an elongate toroidal, and/or an at least partially elongate toroidal squeeze bag 200.

As also illustrated, squeeze bag 200 may include and/or be an elongate squeeze bag. The elongate squeeze bag may define an elongate axis that may extend along and/or parallel to elongate bag axis 202. This may permit the squeeze bag to support stock 50 at a range of different heights relative to support surface 10.

Squeeze bag 200 may be flexible and/or resilient. As an example, and as discussed in more detail herein, squeeze bag 200 may be configured to be gripped by the user to facilitate aiming of the shoulder-fired projectile weapon. In this context, gripping squeeze bag 200 may at least partially immobilize particulate fill-material 280, thereby causing the squeeze bag to transition from being relatively more flexible to being relatively less flexible and providing support for shoulder-fired projectile weapon 30 and/or stock 50 thereof.

Squeeze bag 200 may have and/or define any suitable squeeze bag length 208. Examples of the squeeze bag length include lengths of at least 10 centimeters (cm), at least 12 cm, at least 14 cm, at least 16 cm, at least 18 cm, at least 20 cm, at least 22 cm, at least 24 cm, at most 30 cm, at most 28 cm, at most 26 cm, at most 24 cm, at most 22 cm, at most 20 cm, at most 18 cm, at most 16 cm, and/or at most 14 cm. Squeeze bag 200, additionally or alternatively, may have and/or define any suitable squeeze bag diameter 210, which also may be referred to herein as and/or may be an effective diameter, and/or a maximum transverse dimension, and may be measured within a plane that is perpendicular to elongate bag axis 202. Examples of the squeeze bag diameter include diameters of at least 4 cm, at least 4.5 cm, at least 5 cm, at least 5.5 cm, at least 6 cm, at most 7 cm, at most 6.5 cm, at most 6 cm, at most 5.5 cm, and/or at most 5 cm. Squeeze bag 200, additionally or alternatively, may have any suitable squeeze bag weight. Examples of the squeeze bag weight include weights of at least 50 grams (g), at least 75 g, at least 100 g, at least 125 g, at least 150 g, at least 175 g, at least 200 g, at least 225 g, at least 250 g, at most 500 g, at most 450 g, at most 400 g, at most 350 g, at most 300 g, at most 250 g, and/or at most 200 g. Such squeeze bag lengths 208, squeeze bag diameters 210, and/or squeeze bag weights may readily facilitate convenient carry of shoulder-fired projectile weapons 30 including squeeze bags 200.

Cover material 220 may include and/or be any suitable material that defines elongate bag axis 202 and/or enclosed bag volume 260. Examples of cover material 220 include one or more of a flexible cover material, a resilient cover material, a fabric cover material, and/or a sheet cover material. Additional examples of cover material 220 include a polymeric material, a polymeric fabric, and/or a polymeric sheet. More specific examples of cover material 220 include a polychloroprene material, a fabric-coated polychloroprene material, a neoprene material, a closed-cell foam neoprene material, a fabric-coated neoprene material, a single-backed neoprene material, and/or a double-backed neoprene material. Additional, more specific examples of cover material 220 include a microfiber polyester material, a microfiber polyester with polyurethane binder, a synthetic leather material, and/or a synthetic suede material.

In some examples, cover material 220 may define, at least partially define, or even completely define sling-receiving region 270. As illustrated, cover material 220 may include an outer cover material 230, which may define, at least partially define, or even completely define exposed outer surface 232, and an inner cover material 240, which may define, at least partially define, or even completely define sling-receiving region 270. In addition, outer cover material 230 and inner cover material 240 together may define enclosed bag volume 260.

With reference to FIG. 3, squeeze bags 200 may be configured such that within a, or within any, transverse cross-section of the squeeze bag that extends through the enclosed bag volume, the sling-receiving region and/or perpendicular to the elongate bag axis, the outer cover material is spaced-apart, or entirely spaced-apart, from the inner cover material. As an example and within the transverse cross-section, the fill material and/or the enclosed bag volume may extend between, may extend entirely between, and/or may spatially separate the outer cover material and the inner cover material. In some examples, the outer cover material may define an outer perimeter of the enclosed bag volume, and/or the outer cover material may surround, or entirely surround, the sling-receiving region. In some examples, the inner cover material may define an inner perimeter of the enclosed bag volume, the inner cover material may define an outer perimeter of the sling-receiving region, and/or the inner cover material may surround, or entirely surround, the sling-receiving region. In some examples, an annular, an at least partially annular, or an annular-like region of the enclosed bag volume may be bounded externally by the outer cover material and internally by the inner cover material. In some examples, the enclosed bag volume may surround, or entirely surround, the sling-receiving region and/or the particulate fill-material may surround, or entirely surround, the sling-receiving region.

With reference to FIG. 2, squeeze bags 200 may be configured such that within a longitudinal cross-section of the squeeze bag that extends through the enclosed bag volume, through the sling-receiving region, and/or parallel to the elongate bag axis, the outer cover material and the inner cover material together define a continuous perimeter of cover material that surrounds the enclosed bag volume and/or the fill material. In some such examples, the outer cover material and the inner cover material together may define, or bound, two spaced-apart regions of the enclosed bag volume.

In some examples, squeeze bags 200 and/or cover material 220 thereof may be configured to permit at least partial, or even complete, eversion of the squeeze bags. Stated differently, squeeze bags 200 may be configured to permit relative motion between outer cover material 230 and inner cover material 240 along elongate bag axis 202, such that the inner cover material at least partially, or even completely, defines the exposed outer surface of the squeeze bag, and the outer cover material at least partially, or even completely, defines the sling-receiving region.

In some examples, the outer cover material and the inner cover material may be defined by a single length of cover material. Alternatively and in some examples, outer cover material 230 may differ from inner cover material 240. Examples of the outer cover material and the inner cover material are disclosed herein with reference to cover material 220. In a specific example, the outer cover material includes or is neoprene material, and/or the inner cover material includes or is, synthetic suede material. Such a configuration may permit the outer cover material to be soft, quiet, and/or snag-free, and the inner cover material to be relatively more durable.

Figure 5:
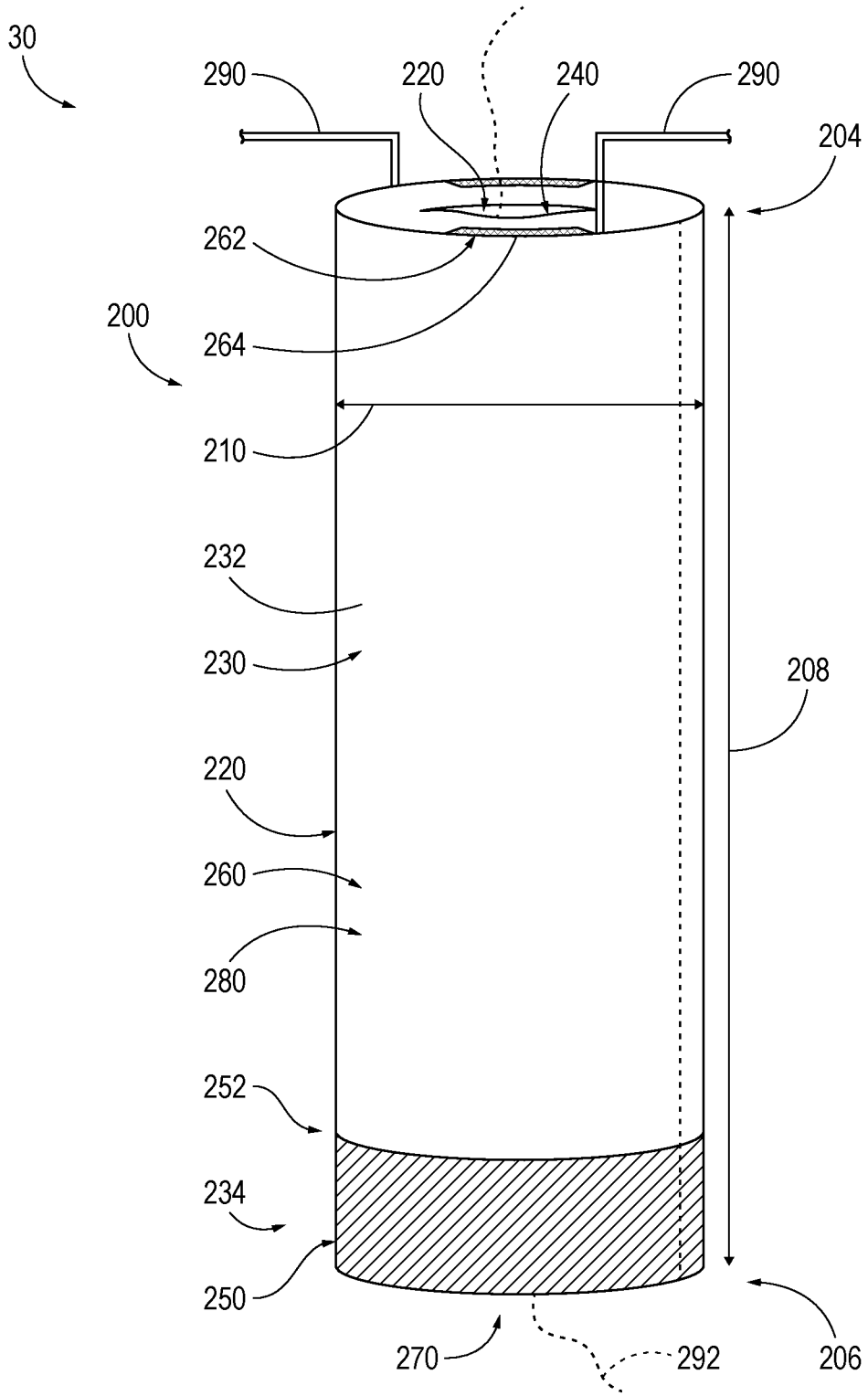
FIG. 5 is a less schematic side view illustrating examples of sling-attached squeeze bags according to the present disclosure.

As illustrated in FIGS. 1-2 and 5, squeeze bags 200 may define a weapon-proximate end 204 and a weapon-distal end 206. Weapon-proximate end 204 may be configured to be relatively proximate shoulder-fired projectile weapon 30; and weapon-distal end 206 may be configured to be relatively distal the shoulder-fired projectile weapon when sling 100 is attached thereto and sling strap 110 is received within sling-receiving region 270 of squeeze bag 200. In some examples and as illustrated in FIGS. 1-2, weapon-proximate end 204 may be configured to contact stock 50, and weapon-distal end 206 may be configured to contact support surface 10 when the stock is supported by the squeeze bag and/or when the user shoots the shoulder-fired projectile weapon. As illustrated in dashed lines in FIGS. 1-2 and in solid lines in FIG. 5, cover material 220 may include an abrasion-resistant material 250. Abrasion-resistant material 250 may define a region 234 of exposed outer surface 232 of the squeeze bag that defines weapon-distal end 206.

Abrasion-resistant material 250, when present, may differ from a remainder of cover material 220, outer cover material 230, and/or inner cover material 240. As an example, abrasion-resistant material 250 may be more abrasion-resistant when compared to the remainder of the cover material, outer cover material 230, and/or inner cover material 240. When cover material 220 includes abrasion-resistant material 250 and outer cover material 230, outer cover material 230 may be shaped to provide a smooth transition 252 between the outer cover material and the abrasion-resistant material along the exposed outer surface of the squeeze bag. Such a configuration may decrease a potential for snagging of and/or noise generation by squeeze bags 200 when shoulder-fired projectile weapons are carried and/or utilized by the user. Additionally or alternatively, abrasion-resistant material 250 may be operatively attached to an outer surface of outer cover material 230, such as via stitching and/or an adhesive.

Sling-receiving region 270 may include any structure that may be adapted, configured, sized, and/or constructed to extend along elongate bag axis 202 and/or to receive sling strap 110 of sling 100. As discussed, sling-receiving region 270 may be at least partially, or even completely, defined and/or bounded by cover material 220 and/or inner cover material 240. Examples of sling-receiving region 270 include an elongate sling-receiving region and/or a tubular sling-receiving region.

Particulate fill-material 280 may include any suitable structure and/or material that may be positioned within enclosed bag volume 260, that may at least partially support stock 50 relative to support surface 10, and/or that may increase in rigidity when compressed and/or squeezed by the user. Examples of particulate fill-material 280 include any suitable particulate, elastomeric particulate, and/or resilient particulate, such as may increase in rigidity when squeezed by the user. More specific examples of particulate fill material 280 include a polymeric material, a particulate polymeric material, polymeric beads, unexpanded polymeric beads, expanded polymeric beads, foam beads, foam pellets, polystyrene, and/or sand. Particulate fill material 280 may have and/or define any suitable particle diameter, average particle diameter, effective particle diameter, and/or average effective particle diameter, examples of which include at least 0.5 millimeters (mm), at least 1 mm, at least 1 mm, at least 2 mm, at least 3 mm, at least 4 mm, at least 5 mm, at most 10 mm, at most 8 mm, at most 6 mm, at most 4 mm, and/or at most 2 mm.

Figure 6:
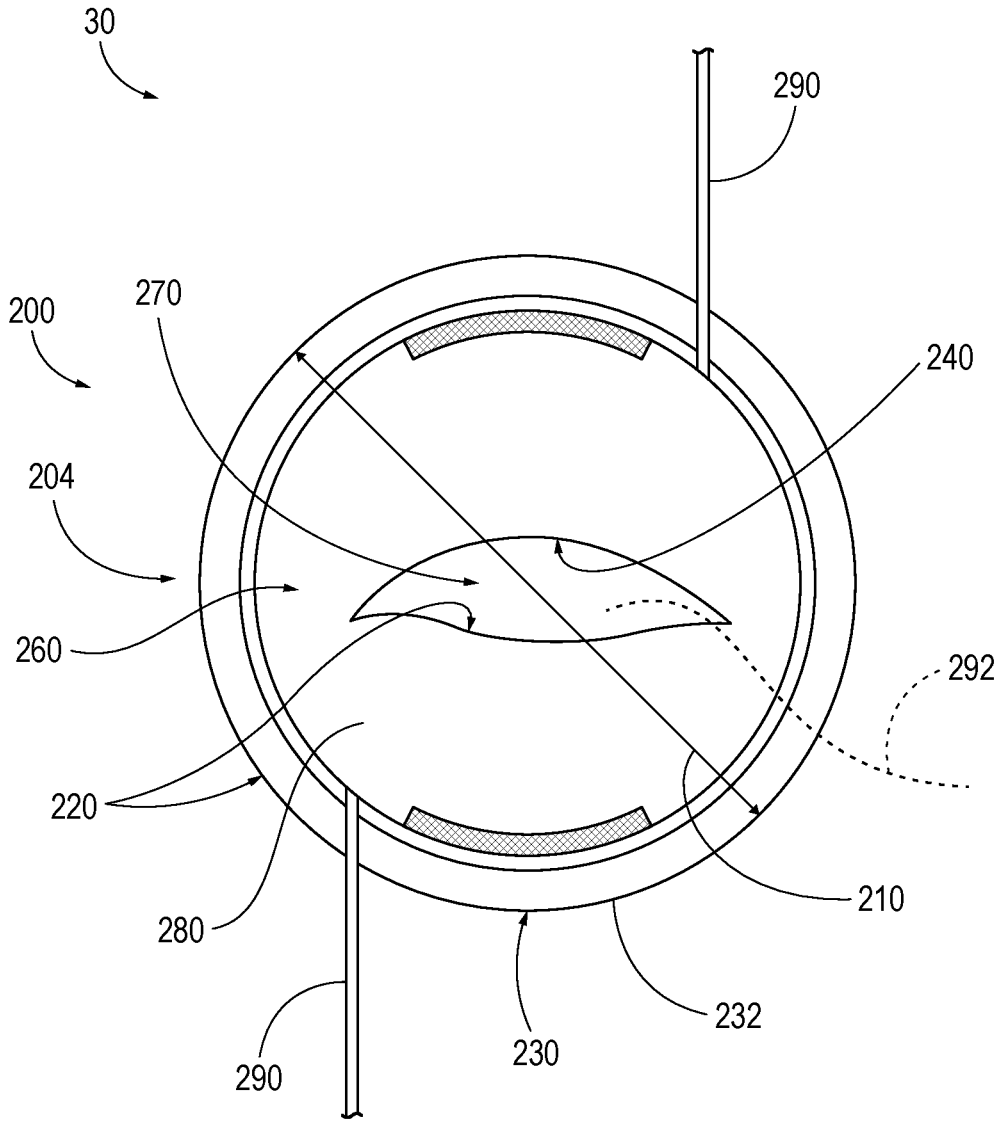
FIG. 6 is a less schematic top view illustrating examples of sling-attached squeeze bags according to the present disclosure.

As illustrated in dashed lines in FIGS. 1-2 and in solid lines in FIGS. 5-6, squeeze bags 200 may include a bag attachment structure 290. Bag attachment structure 290, when present, may be separate, distinct, and/or spaced-apart from sling-receiving region 270 and/or may be configured to facilitate attachment of squeeze bag 200 to shoulder-fired projectile weapon 30, to sling 100, and/or to sling-attachment structure 140 that operatively attaches the sling to the shoulder-fired projectile weapon. Stated differently, sling-receiving region 270 may be configured to permit relative motion between sling 100 and squeeze bags 200 along the length of the sling, and bag attachment structure 290 may be utilized to retain squeeze bags 200 at a predetermined and/or specific location along the length of the sling, relative to the sling, and/or relative to the shoulder-fired projectile weapon. Such a configuration may permit squeeze bags 200 to be more readily and/or quickly utilized to support stock 50 relative to support surface 10. Bag attachment structure 290, when present, may be operatively attached to and/or may extend from weapon-proximate end 204 of squeeze bags 200. Examples of bag attachment structure 290 include a string, a filament, a flexible strand, a cord, a tie cord, and/or a pair of tie cords.

As illustrated in dashed lines in FIG. 6, squeeze bags 200 may include and/or may be utilized with an insertion structure 292. Insertion structure 292 may be configured to facilitate insertion and/or receipt of sling 100 and/or sling strap 110 thereof within sling-receiving region 270 of squeeze bags 200. An example of insertion structure 292 includes a string, a filament, a flexible strand, a cord, and/or an insertion cord, which may extend through, or entirely through, sling-receiving region 270, and/or may be configured to be tied to sling 100 and subsequently utilized to pull sling strap 110 through sling-receiving region 270.

As illustrated in dashed lines in FIG. 1 and solid lines in FIGS. 5-6, cover material 220 may have and/or define a fill-material opening 262, which may be configured to permit and/or facilitate transfer of particulate fill-material 280 into and/or out of enclosed bag volume 260. As an example, fill-material opening 262 may be utilized to transfer the particulate fill-material into and/or out of the enclosed bag volume, thereby selectively increasing or decreasing a rigidity and/or stiffness of the squeeze bags.

In some such examples, squeeze bags 200 also may include a closure mechanism 264. Closure mechanism 264 may be configured to be selectively transitioned between an open configuration, in which the closure mechanism permits transfer of particulate fill-material 280 through fill-material opening 262, and a closed configuration, in which the closure mechanism resists transfer of particulate fill-material through the fill-material opening. Examples of closure mechanism 264 include a zipper and/or a hook-and-loop closure mechanism.

During operative use of shoulder-fired projectile weapons 30 that include slings 100 and sling-attached squeeze bags 200 and as illustrated in FIG. 1, the sling-attached squeeze bag may be positioned between the stock and a support surface 10. Doing so may provide increased and/or improved stability for stock 50, thereby increasing and/or improving an overall stability of shoulder-fired projectile weapon 30, which may increase accuracy and/or precision of the shoulder-fired projectile weapon. In some such examples and as also illustrated in FIG. 1, a forward support 20 also may be utilized to support action 40, barrel 70, and/or forend 80. Examples of forward support 20 include a sand bag, a monopod, a bipod, and/or an arm of the user.

With the above in mind, a method of utilizing squeeze bags 200 in combination with shoulder-fired projectile weapons 30 may include positioning the squeeze bag between the stock of the shoulder-fired projectile weapon and the support surface. During and/or subsequent to the positioning, and as discussed, sling 100 and/or sling strap 110 thereof may extend through sling-receiving region 270 of the squeeze bag. The method of utilizing then may include squeezing the squeeze bag, such as to decrease a mobility of the stock. The squeezing may include squeezing and/or compressing the sling via squeezing and/or compression of the sling-attached squeeze bag.

A method of attaching the sling-attached squeeze bag to the shoulder-fired projectile weapon may include inserting the sling strap of the sling into and/or through the sling-receiving region of the squeeze bag. The inserting may include utilizing the insertion structure to pull the sling strap through the sling-receiving region. The method then may include operatively attaching the sling to the shoulder-fired projectile weapon, such as via a suitable sling-attachment structure, examples of which are disclosed herein. The method of attaching also may include attaching the bag attachment structure of the sling-attached squeeze bag to the shoulder-fired projectile weapon, to the sling, and/or to the sling-attachment structure, such as to retain the squeeze bag at a predetermined location along the length of the sling, relative to the sling, and/or relative to the shoulder-fired projectile weapon.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

Illustrative, non-exclusive examples of sling-attached squeeze bags, of slings, of shoulder-fired projectile weapons, and/or of associated methods, according to the present disclosure, are presented in the following enumerated paragraphs. It is within the scope of the present disclosure that an individual step of a method recited herein, including in the following enumerated paragraphs, may additionally or alternatively be referred to as a "step for" performing the recited action.

A1. A sling-attached squeeze bag for a shoulder-fired projectile weapon, the sling-attached squeeze bag comprising:

a cover material that defines an elongate bag axis and an enclosed bag volume;

a sling-receiving region, or structure, that extends along, or along an entirety of, the elongate bag axis and is sized to receive a sling strap of a sling of the shoulder-fired projectile weapon; and a particulate fill-material positioned within the enclosed bag volume.

A2. The squeeze bag of paragraph A1, wherein the squeeze bag is a tubular, or at least substantially tubular, squeeze bag.

A3. The squeeze bag of any of paragraphs A1-A2, wherein the squeeze bag is a cylindrical, or at least partially cylindrical, squeeze bag.

A4. The squeeze bag of any of paragraphs A1-A3, wherein the squeeze bag is an annular, or at least partially annular, squeeze bag.

A5. The squeeze bag of any of paragraphs A1-A4, wherein the squeeze bag is a toroidal squeeze bag, an at least partially toroidal squeeze bag, an elongate toroidal squeeze bag, or an at least partially elongate toroidal squeeze bag.

A6. The squeeze bag of any of paragraphs A1-A5, wherein the squeeze bag is an elongate squeeze bag that extends along the elongate bag axis.

A7. The squeeze bag of any of paragraphs A1-A6, wherein the squeeze bag is a flexible squeeze bag.

A8. The squeeze bag of any of paragraphs A1-A7, wherein the squeeze bag is configured to be gripped by a user of the shoulder-fired projectile weapon to facilitate aiming the shoulder-fired projectile weapon.

A9. The squeeze bag of any of paragraphs A1-A8, wherein the squeeze bag is configured to at least partially support a stock of the shoulder-fired projectile weapon relative to a support surface when a/the user shoots the shoulder-fired projectile weapon.

A10. The squeeze bag of any of paragraphs A1-A9, wherein the squeeze bag is shaped to decrease a potential for snagging on brush when the sling strap is received within the sling-receiving region and the shoulder-fired projectile weapon is carried by a/the user.

A11. The squeeze bag of any of paragraphs A1-A10, wherein the squeeze bag has a squeeze bag length, as measured along the elongate bag axis, of at least one of:

(i) at least 10 centimeters (cm), at least 12 cm, at least 14 cm, at least 16 cm, at least 18 cm, at least 20 cm, at least 22 cm, or at least 24 cm; and (ii) at most 30 cm, at most 28 cm, at most 26 cm, at most 24 cm, at most 22 cm, at most 20 cm, at most 18 cm, at most 16 cm, or at most 14 cm.

A12. The squeeze bag of any of paragraphs A1-A11, wherein the squeeze bag has a squeeze bag diameter, effective diameter, or maximum transverse dimension as measured perpendicular to the elongate bag axis of at least one of:

(i) at least 4 cm, at least 4.5 cm, at least 5 cm, at least 5.5 cm, or at least 6 cm; and (ii) at most 7 cm, at most 6.5 cm, at most 6 cm, at most 5.5 cm, or at most 5 cm.

A13. The squeeze bag of any of paragraphs A1-A12, wherein the squeeze bag has a squeeze bag weight of at least one of:

(i) at least 50 grams (g), at least 75 g, at least 100 g, at least 125 g, at least 150 g, at least 175 g, at least 200 g, at least 225 g, or at least 250 g; and (ii) at most 500 g, at most 450 g, at most 400 g, at most 350 g, at most 300 g, at most 250 g, or at most 200 g.

A14. The squeeze bag of any of paragraphs A1-A13, wherein the cover material is at least one of:

(i) a flexible cover material;

(ii) a resilient cover material;

(iii) a fabric cover material; and (iv) a sheet cover material.

A15. The squeeze bag of any of paragraphs A1-A14, wherein the cover material includes at least one of:

(i) a polymeric material;

(ii) a polymeric fabric; and (iii) a polymeric sheet.

A16. The squeeze bag of any of paragraphs A1-A15, wherein the cover material includes at least one of:

(i) a polychloroprene material;
(ii) a fabric-coated polychloroprene material;
(iii) a neoprene material;
(iv) a closed-cell foam neoprene material;
(v) a fabric-coated neoprene material;
(vi) a single-backed neoprene material; and
(vii) a double-backed neoprene material.

A17. The squeeze bag of any of paragraphs A1-A16, wherein the cover material includes at least one of:

(i) a microfiber polyester material;
(ii) a microfiber polyester with polyurethane binder;
(iii) a synthetic leather material; and
(iv) a synthetic suede material.

A18. The squeeze bag of any of paragraphs A1-A17, wherein the cover material at least partially, or even completely, defines the sling-receiving region.

A19. The squeeze bag of any of paragraphs A1-A18, wherein the cover material includes an outer cover material, which at least partially, or even completely, defines an exposed outer surface of the squeeze bag, and an inner cover material, which at least partially, or even completely, defines the sling-receiving region.

A20. The squeeze bag of paragraph A19, wherein the outer cover material and the inner cover material together define the enclosed bag volume.

A21. The squeeze bag of any of paragraphs A19-A20, wherein within a transverse cross-section or any transverse cross-section of the squeeze bag that extends at least one of through the enclosed bag volume, through the sling-receiving region, and perpendicular to the elongate bag axis, at least one of:

(i) the outer cover material is spaced-apart, or entirely spaced-apart, from the inner cover material;
(ii) the fill-material extends between, extends entirely between, and/or spatially separates the outer cover material and the inner cover material;
(iii) the enclosed bag volume extends between, extends entirely between, and/or spatially separates the outer cover material and the inner cover material;
(iv) the outer cover material defines an outer perimeter of the enclosed bag volume;
(v) the inner cover material defines an inner perimeter of the enclosed bag volume;
(vi) an annular, an at least partially annular, or an annular-like region of the enclosed bag volume is bounded externally by the outer cover material and internally by the inner cover material;
(vii) the inner cover material defines an outer perimeter of the sling-receiving region;
(viii) the inner cover material surrounds, or entirely surrounds, the sling-receiving region;
(ix) the enclosed bag volume surrounds, or entirely surrounds, the sling-receiving region;
(x) the particulate fill-material surrounds, or entirely surrounds, the sling-receiving region; and
(xi) the outer cover material surrounds, or entirely surrounds, the sling-receiving region.

A22. The squeeze bag of any of paragraphs A19-A21, wherein, within a longitudinal cross-section of the squeeze bag that extends at least one of through the enclosed bag volume, through the sling-receiving region, and parallel to the elongate bag axis, at least one of:

(i) the outer cover material and the inner cover material together define a continuous perimeter of cover material that surrounds the fill-material;
(ii) the outer cover material and the inner cover material together define a/the continuous perimeter of cover material that surrounds the enclosed bag volume; and
(iii) the outer cover material and the inner cover material together define two spaced-apart regions of the enclosed bag volume.

A23. The squeeze bag of any of paragraphs A19-A22, wherein the outer cover material and the inner cover material are defined by a single length of cover material.

A24. The squeeze bag of any of paragraphs A19-A23, wherein the outer cover material differs from the inner cover material.

A25. The squeeze bag of any of paragraphs A19-A24, wherein the outer cover material includes a/the neoprene material.

A26. The squeeze bag of any of paragraphs A19-A25, wherein the inner cover material includes a/the synthetic suede material.

A27. The squeeze bag of any of paragraphs A19-A26, wherein the cover material is configured to permit eversion, such that the inner cover material at least partially, or even completely, defines the exposed outer surface of the squeeze bag, and the outer cover material at least partially, or even completely, defines the sling-receiving region.

A28. The squeeze bag of any of paragraphs A1-A27, wherein the squeeze bag defines a weapon-proximate end configured to be relatively proximate the shoulder-fired projectile weapon when the sling is attached to the shoulder-fired projectile weapon and the sling strap is received within the sling-receiving region, and a weapon-distal end configured to be relatively distal the shoulder-fired projectile weapon and/or to contact a/the support surface when a/the user shoots the shoulder-fired projectile weapon, and further wherein the cover material includes an abrasion-resistant material that defines a region of an/the exposed outer surface of the squeeze bag that defines the weapon-distal end.

A29. The squeeze bag of paragraph A28, wherein the abrasion-resistant material differs from at least one of a remainder of the cover material, an/the outer cover material, and an/the inner cover material.

A30. The squeeze bag of any of paragraphs A28-A29, wherein the cover material includes an/the outer cover material, an/the inner cover material, and the abrasion-resistant material, and further wherein the outer cover material is shaped to provide a smooth transition between the outer cover material and the abrasion-resistant material along the exposed outer surface of the squeeze bag.

A31. The squeeze bag of paragraph A30, wherein the abrasion-resistant material is operatively attached to an outer surface of the outer cover material.

A32. The squeeze bag of any of paragraphs A1-A31, wherein the sling-receiving region includes at least one of an elongate sling-receiving region and a tubular sling-receiving region.

A33. The squeeze bag of any of paragraphs A1-A32, wherein the particulate fill-material includes at least one of:

(i) a polymeric material;
(ii) a particulate polymeric material;
(iii) polymeric beads;
(iv) unexpanded polymeric beads;
(v) expanded polymeric beads;
(vi) foam beads;
(vii) foam pellets;
(viii) polystyrene; and
(ix) sand.

A34. The squeeze bag of any of paragraphs A1-A33, wherein the squeeze bag includes a bag attachment structure that is configured to facilitate attachment of the squeeze bag to at least one of the shoulder-fired projectile weapon, the sling, and a/the sling-attachment structure that operatively attaches the sling to the shoulder-fired projectile weapon.

A35. The squeeze bag of paragraph A34, wherein the bag attachment structure is configured to retain the squeeze bag at a predetermined location at least one of:

(i) along a length of the sling;

(ii) relative to the sling; and (iii) relative to the shoulder-fired projectile weapon.

A36. The squeeze bag of any of paragraphs A34-A35, wherein the bag attachment structure is associated with, or operatively attached to, a/the weapon-proximate end of the squeeze bag.

A37. The squeeze bag of any of paragraphs A34-A36, wherein the bag attachment structure includes at least one of a string, a filament, a flexible strand, a tie cord and a pair of tie cords.

A38. The squeeze bag of any of paragraphs A1-A37, wherein the squeeze bag further includes an insertion structure configured to facilitate receipt of the sling within the sling-receiving region.

A39. The squeeze bag of paragraph A38, wherein the insertion structure includes a string, a filament, a flexible strand, a cord, and/or an insertion cord that extends entirely through the sling-receiving region.

A40. The squeeze bag of any of paragraphs A1-A39, wherein the cover material defines a fill-material opening configured to facilitate transfer of the particulate fill-material at least one of into the enclosed bag volume and out of the enclosed bag volume.

A41. The squeeze bag of paragraph A40, wherein the squeeze bag further includes a closure mechanism configured to be selectively transitioned between an open configuration, in which the closure mechanism permits transfer of the particulate fill-material through the fill-material opening, and a closed configuration, in which the closure mechanism resists transfer of the particulate fill-material through the fill-material opening.

A42. The squeeze bag of paragraph A41, wherein the closure mechanism includes a hook-and-loop closure mechanism.

B1. A sling configured to be operatively attached to a shoulder-fired projectile weapon, the sling comprising:

- a sling strap that defines a bag-receiving strap region configured to be received within a sling-receiving region of a sling-attached squeeze bag;
- a first attachment strap extending from a first end region of the sling strap;
- a second attachment strap extending from the first end region of the sling strap;
- a loop defined on an opposed second end region of the sling strap;
- a first sling-attachment structure operatively attached to the first attachment strap and configured to be selectively attached to a left side of a stock of the shoulder-fired projectile weapon; and
- a second sling-attachment structure operatively attached to the second attachment strap and configured to be selectively attached to a right side of the stock of the shoulder-fired projectile weapon.

B2. The sling of paragraph B1, wherein at least one of the first sling-attachment structure and the second sling-attachment structure includes at least one of a swivel, a sling swivel, a sling mount, a quick-detach sling mount, and a quick-detach sling swivel.

B3. The sling of any of paragraphs B1-B2, wherein at least one of the first attachment strap, the second attachment strap, and the sling strap is defined by at least one of a fabric strap material, a webbed strap material, and a nylon webbed strap material.

B4. The sling of any of paragraphs B1-B3, wherein a first distance between the first sling-attachment structure and the sling strap, as measured along the first attachment strap, and a second distance between the second sling-attachment structure and the sling strap, as measured along the second attachment strap, is selected to permit the stock to rotate directly between the first attachment strap and the second attachment strap when the first sling-attachment structure is selectively attached to the left side of the stock and the second sling-attachment structure is selectively attached to the right side of the stock.

B5. The sling of paragraph B4, wherein the first distance is equal, or at least substantially equal, to the second distance.

B6. The sling of any of paragraphs B1-B5, wherein the loop is sized to receive a shoulder of a user of the shoulder-fired projectile weapon.

B7. The sling of any of paragraphs B1-B6, wherein the loop is sized to receive a coupler of a sling extension.

B8. The sling of paragraph B7, wherein the sling includes the sling extension, and further wherein the sling extension includes a sling extension loop sized to receive a shoulder of a user of the shoulder-fired projectile weapon.

B9. The sling of any of paragraphs B1-B8, wherein the sling further includes the sling-attached squeeze bag, wherein the bag-receiving strap region is received within the sling-receiving region of sling-attached squeeze bag.

B10. The sling of paragraph B9, wherein the sling-attached squeeze bag includes any suitable structure, function, and/or feature of any of the sling-attached squeeze bags of any of paragraphs A1-A42.

B11. The sling of any of paragraphs B9-B10, wherein a/the tie string of the squeeze bag is operatively attached to the sling.

C1. A shoulder-fired projectile weapon, comprising:

- an action;
- a stock extending from the action and configured to be shouldered by a user of the shoulder-fired projectile weapon;
- a sling;
- a sling-attachment structure that operatively attaches the sling to the stock; and
- a sling-attached squeeze bag operatively attached to the sling.

C2. The shoulder-fired projectile weapon of paragraph C1, wherein the sling-attached squeeze bag includes any suitable structure, function, and/or feature of any of the sling-attached squeeze bags of any of paragraphs A1-A42.

C3. The shoulder-fired projectile weapon of any of paragraphs C1-C2, wherein the sling includes any suitable structure, function, and/or feature of any of the slings of any of paragraphs B1-B11.

C4. The shoulder-fired projectile weapon of paragraph C3, wherein the stock defines a first receptacle, which is configured to receive the first sling-attachment structure and is defined on the left side of the stock, and a second receptacle, which is configured to receive the second sling-attachment structure and is defined on the right side of the stock.

C5. The shoulder-fired projectile weapon of paragraph C4, wherein at least one of:

(i) the first receptacle is coaxial with the second receptacle; and (ii) a single hole through the stock and between the left side and the right side at least partially, or even completely, defines both the first receptacle and the second receptacle.

C6. The shoulder-fired projectile weapon of any of paragraphs C1-C5, wherein the shoulder-fired projectile weapon includes at least one of:

(i) a firearm;

(ii) a rifle;

(iii) a modern sporting rifle;

(iv) a shotgun;

(v) a speargun;

(vi) a paintball gun; and (vii) a crossbow.

D1. A method of attaching the sling-attached squeeze bag of any of paragraphs A1-A42 to a shoulder-fired projectile weapon, the method comprising:

inserting the sling strap into the sling-receiving region; and operatively attaching the sling to the shoulder-fired projectile weapon.

D2. The method of paragraph D1, wherein the method further includes attaching a/the bag attachment structure of the sling-attached squeeze bag to at least one of the shoulder-fired projectile weapon, the sling, and the sling-attachment structure to retain the squeeze bag at a predetermined location at least one of along a/the length of the sling, relative to the sling, and relative to the shoulder-fired projectile weapon.

D3. The method of any of paragraphs D1-D2, wherein the sling includes any suitable structure, function, and/or feature of any of the slings of any of paragraphs B1-B11.

D4. The method of any of paragraphs D1-D3, wherein the shoulder-fired projectile weapon includes any suitable structure, function, and/or feature of any of the shoulder-fired projectile weapons of any of paragraphs C1-C6.

E1. A method of utilizing a sling-attached squeeze bag in combination with a shoulder-fired projectile weapon, the method comprising:

positioning the squeeze bag between a stock of the shoulder-fired projectile weapon and a support surface, wherein, during the positioning, a sling of the shoulder-fired projectile weapon extends through a sling-receiving region of the sling-attached squeeze bag; and squeezing the sling-attached squeeze bag to decrease a mobility of the stock, wherein the squeezing the sling-attached squeeze bag includes squeezing the sling via the sling-attached squeeze bag.

INDUSTRIAL APPLICABILITY

The sling-attached squeeze bags, slings, shoulder-fired projectile weapons, and associated methods disclosed herein are applicable to the hunting and shooting sports industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A sling-attached squeeze bag for a shoulder-fired projectile weapon, the squeeze bag comprising:

a cover material that defines an elongate bag axis and an enclosed bag volume;

a sling-receiving region that extends along the elongate bag axis and is sized to receive a sling strap of a sling of the shoulder-fired projectile weapon; and a particulate fill-material positioned within the enclosed bag volume;

wherein the cover material includes an outer cover material, which at least partially defines an exposed outer surface of the squeeze bag, and an inner cover material, which at least partially defines the sling-receiving region; and wherein, within a transverse cross-section of the squeeze bag that extends at least one of through the enclosed bag volume, through the sling-receiving region, and perpendicular to the elongate bag axis, the outer cover material defines an outer perimeter of the enclosed bag volume and the inner cover material defines an inner perimeter of the enclosed bag volume.

2. The squeeze bag of claim 1, wherein the squeeze bag has:

(i) a squeeze bag length, as measured along the elongate bag axis, of at least 10 centimeters (cm) and at most 30 cm; and (ii) a squeeze bag maximum transverse dimension, as measured perpendicular to the elongate bag axis, of at least 4 cm and at most 7 cm.

3. The squeeze bag of claim 1, wherein the squeeze bag has a squeeze bag weight of at least 50 grams (g and at most 500 g.

4. The squeeze bag of claim 1, wherein the outer cover material and the inner cover material together define the enclosed bag volume.

5. The squeeze bag of claim 4, wherein the outer cover material and the inner cover material both directly contact the particulate fill-material.

6. The squeeze bag of claim 1, wherein, within a longitudinal cross-section of the squeeze bag that extends at least one of through the enclosed bag volume, through the sling-receiving region, and parallel to the elongate bag axis, the outer cover material and the inner cover material together define two spaced-apart regions of the enclosed bag volume.

7. The squeeze bag of claim 1, wherein the outer cover material differs from the inner cover material.

8. The squeeze bag of claim 1, wherein the cover material is configured to permit eversion such that the inner cover material at least partially defines the exposed outer surface of the squeeze bag and the outer cover material at least partially defines the sling-receiving region.

9. The squeeze bag of claim 1, wherein the squeeze bag defines a weapon-proximate end, which is configured to be relatively proximate the shoulder-fired projectile weapon when the sling is attached to the shoulder-fired projectile weapon and the sling strap is received within the sling-receiving region, and a weapon-distal end, which is configured to be relatively distal the shoulder-fired projectile weapon and to contact a support surface when a user shoots the shoulder-fired projectile weapon, and further wherein the cover material includes an abrasion-resistant material that defines a region of the exposed outer surface of the squeeze bag that defines the weapon-distal end, wherein the abrasion-resistant material differs from a remainder of the cover material.

10. The squeeze bag of claim 1, wherein the particulate fill-material includes a particulate polymeric material.

11. The squeeze bag of claim 1, wherein the squeeze bag includes a bag attachment structure that is configured to facilitate attachment of the squeeze bag to at least one of the shoulder-fired projectile weapon, the sling, and a sling-attachment structure that operatively attaches the sling to the shoulder-fired projectile weapon.

12. The squeeze bag of claim 11, wherein the bag attachment structure is configured to retain the squeeze bag at a predetermined location at least one of:

(i) along a length of the sling;

(ii) relative to the sling; and (iii) relative to the shoulder-fired projectile weapon.

13. The squeeze bag of claim 1, wherein the squeeze bag further includes an insertion structure configured to facilitate receipt of the sling within the sling-receiving region, wherein the insertion structure includes a flexible strand that extends entirely through the sling-receiving region.

14. The squeeze bag of claim 1, wherein the cover material defines a fill-material opening configured to facilitate transfer of the particulate fill-material at least one of into the enclosed bag volume and out of the enclosed bag volume.

15. The squeeze bag of claim 14, wherein the squeeze bag further includes a closure mechanism configured to be selectively transitioned between an open configuration, in which the closure mechanism permits transfer of the particulate fill-material through the fill-material opening, and a closed configuration, in which the closure mechanism resists transfer of the particulate fill-material through the fill-material opening.

16. A method of attaching the sling-attached squeeze bag of claim 1 to the shoulder-fired projectile weapon, the method comprising:

inserting the sling strap into the sling-receiving region; and operatively attaching the sling to the shoulder-fired projectile weapon.

17. The squeeze bag of claim 1, wherein:

(i) the transverse cross-section of the squeeze bag extends through the enclosed bag volume, through the sling-receiving region, and perpendicular to the elongate bag axis; and (ii) the outer perimeter of the enclosed bag volume extends entirely around the inner perimeter of the enclosed bag volume.

18. A sling configured to be operatively attached to a shoulder-fired projectile weapon, the sling comprising:

the sling-attached squeeze bag of claim 1;

a sling strap that defines a bag-receiving strap region that is received within the sling-receiving region of the sling-attached squeeze bag;

a first attachment strap extending from a first end region of the sling strap;

a second attachment strap extending from the first end region of the sling strap;

a loop defined on an opposed second end region of the sling strap;

a first sling-attachment structure operatively attached to the first attachment strap and configured to be selectively attached to a left side of a stock of the shoulder-fired projectile weapon; and a second sling-attachment structure operatively attached to the second attachment strap and configured to be selectively attached to a right side of the stock of the shoulder-fired projectile weapon.

19. A shoulder-fired projectile weapon, comprising:

an action;

a stock extending from the action and configured to be shouldered by a user of the shoulder-fired projectile weapon;

a sling;

a sling-attachment structure that operatively attaches the sling to the stock; and the sling-attached squeeze bag of claim 1 operatively attached to the sling.

20. A method of utilizing the shoulder-fired projectile weapon of claim 19, the method comprising:

positioning the sling-attached squeeze bag between the stock of the shoulder-fired projectile weapon and a support surface, wherein, during the positioning, the sling of the shoulder-fired projectile weapon extends through a sling-receiving region of the sling-attached squeeze bag; and squeezing the sling-attached squeeze bag to decrease a mobility of the stock, wherein the squeezing the sling-attached squeeze bag includes squeezing the sling via the sling-attached squeeze bag.

* * * * *